US007043853B2

(12) United States Patent
Roberts et al.

(10) Patent No.: US 7,043,853 B2
(45) Date of Patent: May 16, 2006

(54) KILN WITH PROCESS WATER EVAPORATION SYSTEM

(75) Inventors: C. Wayne Roberts, Grenada, MS (US); Harold Wayne Hankins, Ripley, MS (US); Karl H. Grubb, Grenada, MS (US); Joel S. Bridges, Grenada, MS (US); David E. Miles, Sumrall, MS (US); Michael L. Miles, Monticello, MS (US)

(73) Assignee: Waco Construction Co., Inc., Grenada, MS (US)

( * ) Notice: Subject to any disclaimer, the term of this patent is extended or adjusted under 35 U.S.C. 154(b) by 0 days.

(21) Appl. No.: 10/774,049

(22) Filed: Feb. 4, 2004

(65) Prior Publication Data

US 2004/0168339 A1 Sep. 2, 2004

Related U.S. Application Data

(60) Provisional application No. 60/444,841, filed on Feb. 4, 2003.

(51) Int. Cl.
*F26B 7/00* (2006.01)

(52) U.S. Cl. ..... 34/73; 34/76; 34/396

(58) Field of Classification Search ..... 34/73–78, 34/215, 396, 218, 469, 212
See application file for complete search history.

(56) References Cited

U.S. PATENT DOCUMENTS 3,986,268 A 10/1976 Koppelman
4,014,107 A 3/1977 Bachrick
4,250,629 A * 2/1981 Lewis ..... 34/380
4,343,095 A 8/1982 Rosen et al.
RE31,633 E 7/1984 Lewis
4,467,532 A * 8/1984 Drake ..... 34/407
4,597,772 A 7/1986 Coffman
4,620,373 A 11/1986 Laskowski et al.
5,107,607 A 4/1992 Mason
5,123,177 A 6/1992 Koetter et al.
5,138,773 A 8/1992 Goodwin et al.
5,228,209 A * 7/1993 Brunner ..... 34/417
5,380,402 A 1/1995 Ryham et al.
5,392,530 A 2/1995 Izumi
5,595,000 A 1/1997 Goodwin, III
5,645,616 A 7/1997 McIlroy et al.
5,762,758 A 6/1998 Hoffman
5,766,412 A 6/1998 Railey
5,926,968 A * 7/1999 Gipson ..... 34/77
5,979,074 A * 11/1999 Brunner et al. ..... 34/396
6,071,380 A 6/2000 Hoffman
6,370,792 B1 4/2002 Culp et al.
6,467,190 B1 10/2002 Nagel et al.

* cited by examiner

*Primary Examiner*—Kenneth Rinehart
(74) *Attorney, Agent, or Firm*—Stites & Harbison PLLC; Richard S. Myers, Jr.

(57) ABSTRACT

A process and apparatus for drying a stack of lumber, wherein the dry comprises a condensation collection device for collecting liquid in the chamber interior space; and an evaporation system for evaporating collected liquid from the chamber interior space. Process water or effluent discharge from the drying process is reduced or eliminated.

24 Claims, 9 Drawing Sheets

KILN WITH PROCESS WATER EVAPORATION SYSTEM

PRIORITY STATEMENT

This application claims priority to U.S. Application Ser. No. 60/444,841, filed on Feb. 4, 2003, the contents of which are incorporated herein by reference in their entirety.

FIELD OF THE INVENTION

The present invention relates to the field of kiln systems and, more particularly to a kiln chamber for drying lumber that has little or no process water waste. As discussed below, an embodiment of the present invention is a kiln system that does not pollute the environment with the production and discharge of liquid waste.

BACKGROUND OF THE INVENTION

Lumber that has recently been cut contains a relatively large percentage of water and is referred to as green lumber. Prior to being used in applications that demand good grades of lumber, the green lumber must be dried. Drying removes a large amount of water from the lumber and significantly reduces the potential for the lumber to become warped or cracked. Although lumber may be dried in ambient air, kiln drying accelerates and provides increased control over the drying process.

Many manufacturing processes involve the use of water, if only for cooling purposes. Water that comes into contact with manufacturing processes is, with few exceptions, considered by environmental regulatory agencies to be "Process Water". Process water is considered to be contaminated as a result of its contact with the manufacturing process. By regulation, process water, must not be allowed to drain freely away, thereby contaminating streams, watercourses, etc. The costs associated with conventional collection and treatment methods discourage compliance on the part of originators. More originators of process water exist than regulatory officials empowered to ensure compliance. Much process water is thus therefore allowed to escape and to detrimentally impact the environment.

Additionally, the water removed from the wood may eventually reach the point of saturating the space within the chamber with water vapor, at which point, the drying process would come to a halt, or at least be slowed considerably. By cooling the water vapor and condensing it into liquid water, the water vapor pressure in the chamber is kept below the saturation point, thereby continuing the evaporation of water from the wood, and avoiding the condensation of water on the wood. Many prior art kilns have mechanisms to remove excess condensation.

For example, in U.S. Pat. No. 4,343,095 to Rosen et al., water that accumulates on the bottom of the drying chamber from condensation of steam or from free water being forced out of the ends of the boards by internal pressure in the wood, is periodically ejected from the dryer.

In U.S. Pat. No. 5,595,000 to Goodwin, III, coils are used to control condensation. The air passing through the coil is cooled to well below the dew point which causes a condensation of moisture onto coil. The moisture condensed on coil is removed from the kiln by the condensate removal system.

U.S. Pat. No. 4,620,373 to Laskpwski et al. discloses a kiln that has evaporator hoses that condense the moisture that is removed from the wood into water, which is removed from the chamber into a storage tank by a pump.

U.S. Pat. No. 3,986,268 to Koppelman discloses a kiln that comprises a shroud or jacket to collect condensate. The condensate exits the tank through a drain at the bottom of the tank.

While care has been taken to control and/or remove condensation in and surrounding the kiln chamber, such measures do not address the problem of waste water or process water.

To overcome the above problems of properly dealing with and disposing of process water, waste water and/or condensation, the present inventors have proposed a method in which the volume of process water produced during a manufacturing process can be drastically reduced or eliminated.

SUMMARY AND OBJECTS OF THE INVENTION

Generally speaking, the present invention relates to an apparatus that may be used to dry lumber that greatly reduces or essentially eliminates the process water (effluent).

In one embodiment of the present invention, latent heat of the manufacturing process can be used, completely and cost-effectively evaporate the collected effluent while remaining within the confines of existing governmental air quality permitting restrictions.

In other embodiments of the present invention, the methods of capturing and evaporating effluent is adapted to other manufacturing processes in addition to the methods of drying disclosed herein. For example, industries that utilize both heat and water in their manufacturing processes may benefit from the present invention. The manufacture of steel, aluminum, copper, brass, plastics, synthetic rubber, as well as any of these or similar materials which may be subsequently molded, formed, pressed, machined, cured, baked, dried, etc. are examples. The food processing industry, pulp and paper manufacturing, power generation, glass manufacturing, chemical manufacturing, etc. are further examples.

The process of the present invention will function in cross-discipline applications as well. That is, the latent heat used to evaporate the process water need not necessarily be that heat involved in the origination of the process water. A user of the present invention can receive process water from any on-site permitted source and evaporate that water via the latent heat generated in a separate, on-site process.

Accordingly, one embodiment of the present invention is a dry kiln system for drying a stack of lumber. This system comprises at least one kiln chamber defining a chamber interior space capable of receiving a stack of lumber for drying. This system may comprise one, two, three or more of such chambers. Typically a kiln has one chamber. Thus, embodiments may include multiple kiln chambers that are part of multiple kilns. The system of this embodiment includes a chamber heating source capable of providing heated air; an air moving device capable of circulating heated air supplied to the chamber interior space; a condensation collection device for collecting liquid in the chamber interior space; and an evaporation system for evaporating collected liquid from the chamber interior space.

Another embodiment of the present invention is a process for drying lumber. This process may comprise the steps of providing a kiln system. This kiln system may be any kiln system disclosed herein that includes an evaporation system of the present invention. In this embodiment, the kiln system includes a chamber interior space for receiving a quantity of stacked lumber; a chamber heating source for heating the air within the structure for drying the lumber; and a condensation collection device for collecting liquid in the chamber interior space. The steps of this process include placing a quantity of stacked wet/green lumber within the chamber interior surface; circulating heated air within the chamber interior surface and about the stacked lumber to dry the lumber and cause liquid in the wet lumber to escape as vapor; collecting liquid from condensed vapor in the chamber interior surface; and evaporating said liquid to prevent effluent liquid discharge into the environment.

An object of the present invention is to provide an apparatus and method for drying green lumber with reduced discharge of liquid pollutants such as process water to the environment.

It is another object of the present invention to provide an apparatus and method for the drying of green lumber with essentially no discharge of liquid pollutants such as process water to the environment.

These and other embodiments will be apparent from the description of the present invention and the claims.

DETAILED DESCRIPTION OF THE INVENTION

The invention was developed originally to address the needs of the lumber manufacturing industry. As stated above, a problem facing the industry is proper disposal of dry kiln condensate. The present inventors discovered they could evaporate all condensate generated and have excess capacity which may be used to dispose of process water from other sources, saw boxes, etc., as well.

Figure 1:
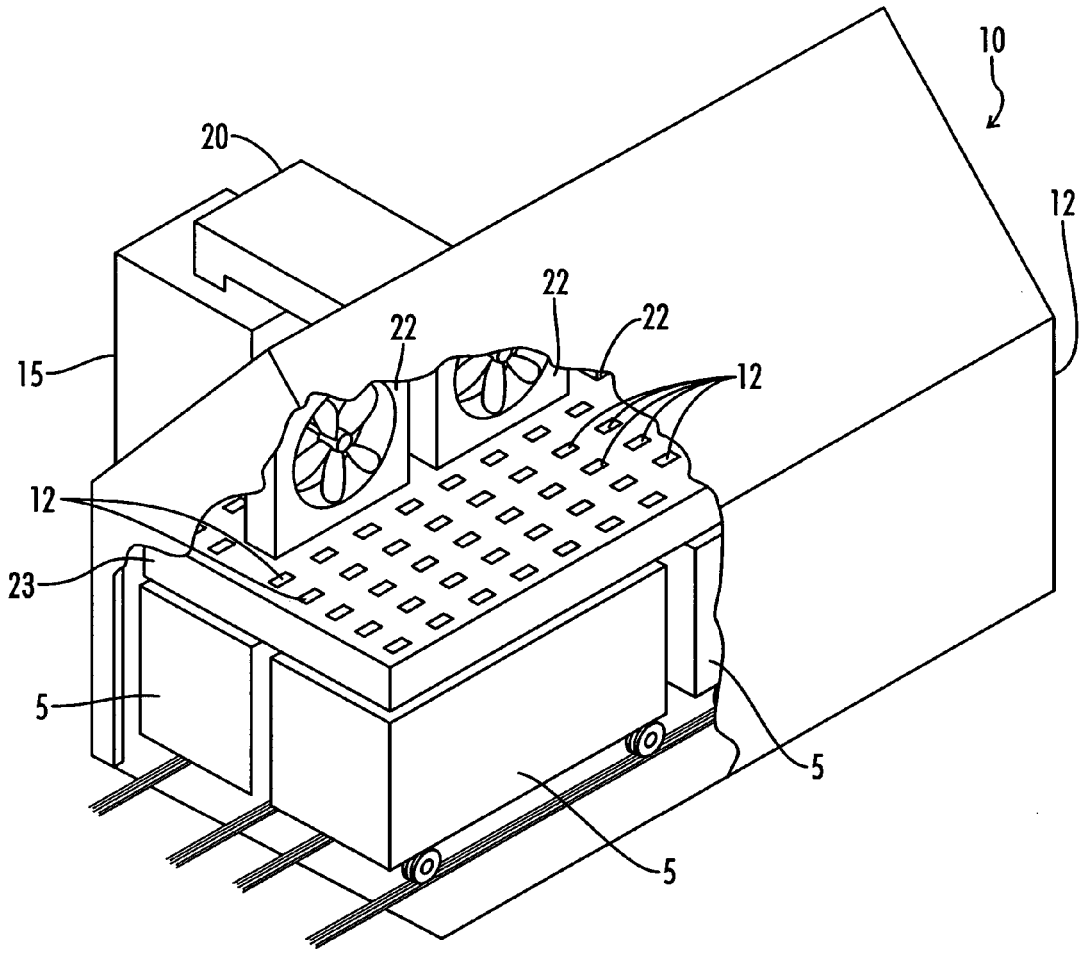
FIG. 1 (PRIOR ART)
FIG. 1 is a partially schematic, partially cut away pictorial view of the portions of a conventional kiln system. The system depicted here can be adapted for use with the present invention.

FIG. 1 illustrates certain aspects of an example of a conventional kiln 10. The conventional kiln 10 includes, or defines, a kiln chamber 12. This chamber receives lumber 5 to be dried. As with most conventional kilns, the kiln chamber is generally a rectangular building that could be at least partially sealed to control the amount of air that is introduced to and exhausted from the chamber 12. Hot air is provided by a heat source 15, which may a furnace. Hot air from the heat source 15 is forced through an air flow source 20 or inlet duct 20 to a plenum 23 that is typically positioned in an upper portion of the kiln chamber 12. The hot air is discharged from the plenum 23 to the interior of the kiln chamber 12 through multiple outlets 24. These outlets are typical to find in the top panel of the plenum. Usually the air flow source 20 comprises multiple, reversible fans 22 to help accommodate heat air flow throughout the lumber. When the lumber has reached an adequate drying point, the kiln chamber is opened and the lumber is removed from the chamber. While conventional kiln systems such as the type illustrated in FIG. 1 are functional, the drawback is that they are not equipped to handle the discharge of excess water from the drying lumber.

An element of our design is to ensure that process water (kiln condensate, etc) is not discharged to the environment. In certain embodiments, this is accomplished by sloping contact surfaces to central drains, removing sediment in the process, and utilizing gravity wherever possible, transporting collected effluent to remote repositories. Other embodiments include elements to prevent weather induced precipitation, (rain, snow, etc.), from coming into contact with process water. This may be accomplished by sloping process surfaces to drains, outside surfaces slightly away from process areas, and by installing grated trench drains and/or sealed walls at all process/non-process area junctures.

Trees, as is the case with most living things, are composed of large percentages of water, often as much as 45% to 50%. The reduction of this percentage to manageable levels (approx. 19% or less) is desired. This water is removed during the kiln drying process. Most, but not all, of this process water is evaporated to atmosphere during the drying process. Once the remaining process water is properly stored, we must begin to address its disposal.

Air Quality Permits are required in most locales. Those permits are based in part upon theoretical volatile organic compound (VOC) levels in given volumes of wood, together with anticipated production levels. Testing has shown that actual VOC discharges fall considerably below permitted levels. The reason for this is that not all removed water with its entrained contaminates is evaporated to atmosphere. Much of this process water condenses on the surfaces of the kilns and becomes process water (dry kiln condensate).

Figure 2:
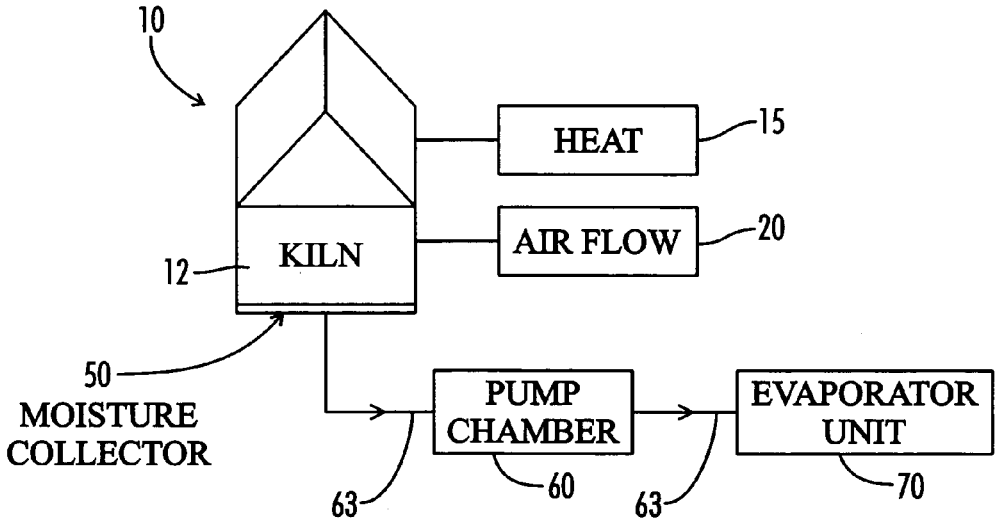
FIG. 2 is a block diagram showing a kiln system of the present invention.

As stated above, at the bottom of the present invention is a dry kiln system for drying a stack of lumber. Referring to FIG. 2, this kiln system comprises of at least one kiln 10 defining a chamber interior space 12 capable of receiving a stack of lumber. The lumber may be introduced to the kiln system via tracks or could be inserted by means of a fork lift type device. The kiln system further comprises a chamber heating source 15 capable of providing heated air. This heating source may be a furnace that is conventional in the kiln industry. The kiln chamber further comprises an air emitting device 20 capable of circulating heated air supplied to the chamber interior space. This air moving device may comprise air ducts, fans, plenums, etc., all of which are not known to be critical with respect to the present invention as long as they can properly function in lumber drying techniques. The kiln 10 comprises a condensation device 50 or moisture collector 50 that assists in collecting liquid such as condensate in the interior chamber space. The system further comprises an evaporation system 70 or evaporation unit 70 for evaporating the collected from the chamber interior space.

In one embodiment, the condensation collection device 50 or moisture collector 50 may be an evaporator coil in the chamber interior space. U.S. Pat. No. 5,595,000 describes a coil used to control condensation in a kiln. The air passing through the coil is cooled well below the dew point which causes a condensation of the moisture onto the coil. The moisture condensed on the coil is removed from the kiln and delivered to the evaporation unit 70. In other embodiments, the evaporator hoses of U.S. Pat. No. 4,620,373 may be used to condense the moisture that is removed from the wood into water. Additionally, the shroud or jacket of U.S. Pat. No. 3,986,298 maybe used to collect excess moisture in the chamber. In one embodiment of the present invention, the condensation device or moisture collector may comprise a liquid contact surface such as the floor of the kiln chamber. The floor may direct liquid to a drain system, which in turn delivers the liquid to an evaporation unit. In some embodiments, the liquid contact surface may simply be a sloping floor, allowing gravity to assist in delivering the liquid to a drainage system and eventually downstream to the evaporation unit. As its name implies, the evaporation unit assists in converting the processed water into a vapor which may be discharged into the environment. Typically the evaporation system will comprise an evaporation device heating source, where in the heating source effects evaporation of the liquid in the holding tank. In some examples, the heating source for the kiln chamber may direct heat or residual heat to the evaporation system to help effect evaporation.

The evaporation unit 70 or evaporation device 70 may comprise a liquid holding tank. The processed water may be heated in the liquid holding tank to effect evaporation of the liquid in the holding tank.

Additionally, the evaporation device may comprise a pump to direct the collected water back into the kiln chamber for heating to effect evaporation. A pump chamber 60 may be used to direct flow of the processed water in the kiln system.

Figure 3:
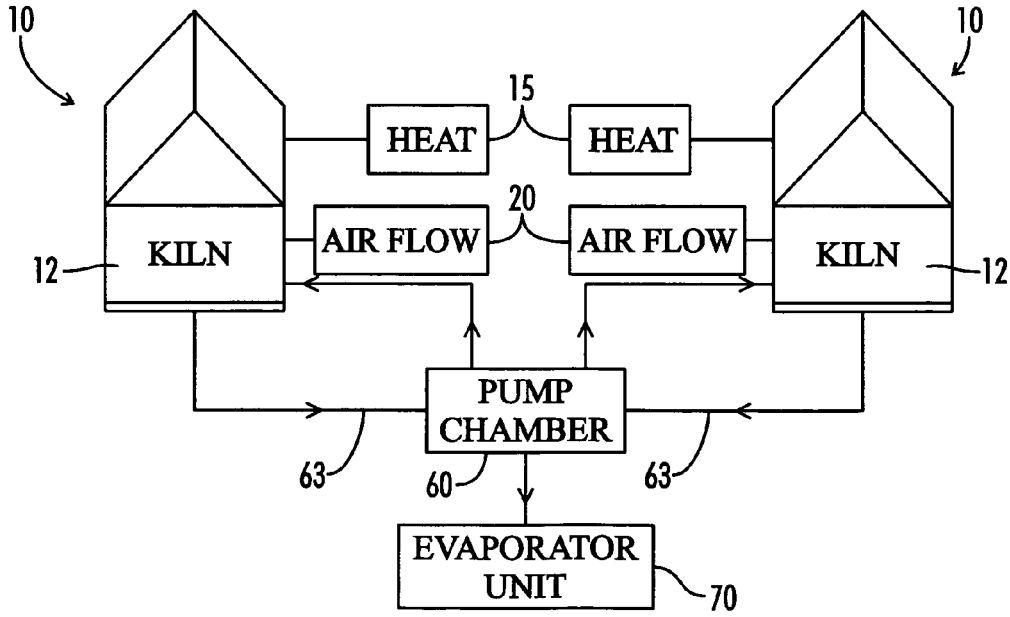
FIG. 3 is a block diagram showing a kiln system of the present invention that comprises two kiln, each of which have a chamber defining an interior space that is used for drying green lumber.
Figure 4:
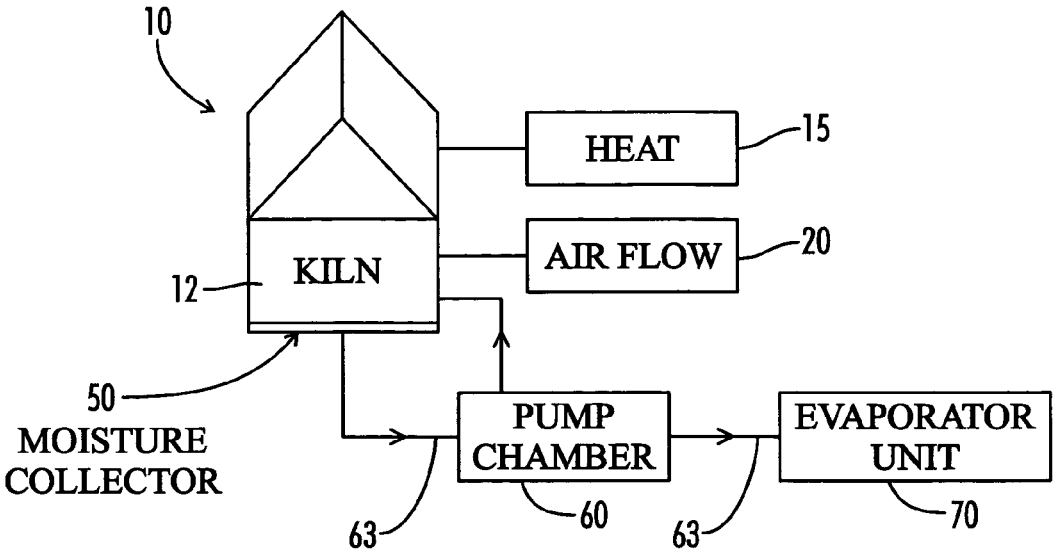
FIG. 4 is a block diagram showing another embodiment of the present invention. In this embodiment the process water is directed back to a kiln chamber for evaporation.
Figure 5:
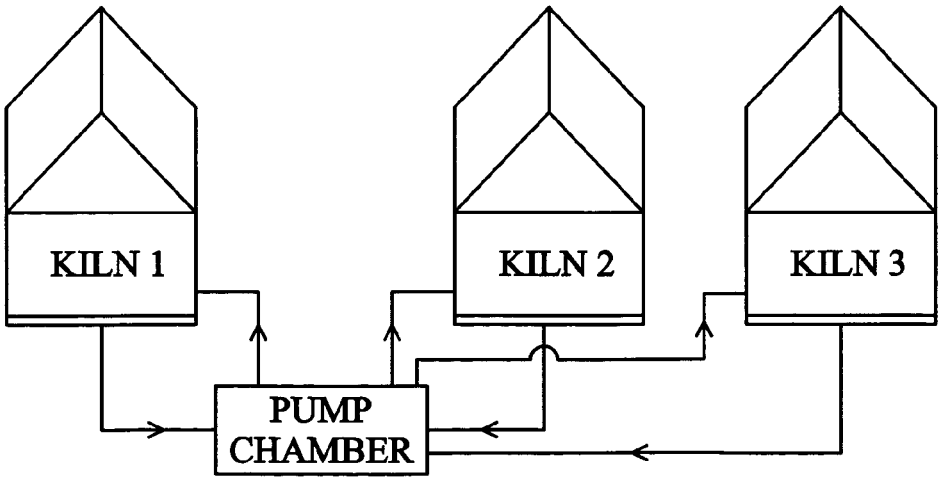
FIG. 5 is another embodiment that, like the embodiment of FIG. 3, comprises two kilns. These kilns have the process water pumped back into their interior chamber for evaporation.

As shown in FIG. 3, the kiln system of the present invention may comprise a plurality of kilns 10, each of which define a chamber interior space 12 capable of receiving a stack of lumber for drying. The kiln chambers of this embodiment may be the same or different. Nonetheless, each kiln chamber may be provided with a moisture collector 50 to collect and direct water via a pump chamber 60 to an evaporation unit 70. In this regard, the pump chamber may direct water to a central evaporation or a central liquid holding tank which may hold water for more than one kiln chamber, or the pump chamber may direct fluid back into a kiln for evaporation. In the preferred embodiment, the pump chamber may be equipped with a control device which directs fluid to and from each kiln. The control device would allow an operator to direct the processed water from each kiln chamber into one or more specific locations, such as an individual kiln chamber, multiple kiln chambers, and/or a liquid evaporation unit.

The present invention also comprises a process for drying lumber. This process comprises providing a kiln system. The kiln system of this embodiment is not known to be critical, as long as it can be equipped with a moisture collector which directs water through a pump chamber to an evaporation device. In the case of using a prior art kiln chamber, the kiln chamber must also be capable of being equipped with an evaporation device should the embodiment be used that directs processed water back into the kiln chamber to effect evaporation. The process of this embodiment also may comprise multiple kilns, and may comprise a control unit in connection with the pump chamber to direct processed water flow from each kiln chamber to at least one of a kiln chamber, central evaporation unit, multiple evaporation units, or any combination thereof.

The present invention may re-introduce stored process water to the kiln chamber at selected intervals during the drying cycle. This water, formerly steam, is quite warm (typically about 200 degrees F.).

In a preferred embodiment, a series of pumps and related valves and controls is used to spread the captured liquid widely and thinly across a sloped concrete floor of the kiln and, utilizing the latent heat of the drying process, fully evaporate that water. Modifications to normal venting techniques are required, and the process may be completely automated to maximize efficiency of the process.

One of ordinary skill in the art would understand that there are various methods available to re-introduce the process water. Alternatively, the process water can be evaporated by using an additional or ancillary evaporation tank, tray, reservoir, or other device suitable for that purpose.

With respect to the process and apparatus of the present invention, the quality of the lumber is reportedly improved as a result of the conditioning aspects of the late cycle steam introduced to the kilns.

Additionally, little additional energy is expended in the disposal of process water utilizing our design. Operators may choose to evaporate all, part, or none of the collected effluent as they choose. For instance, in a multiple kiln configuration with a varied mix of lumber, an operator may choose to evaporate the majority of his collected effluent in kilns containing timbers (longer duration) as opposed to evaporating that water in kilns containing premium grade decking (shorter duration), etc.

The present invention typically allows for easier compliance. Air quality permits are typically based upon theoretical VOC content, and the present invention merely reintroduces effluent already considered within those theoretical levels. The present invention does not exceed those levels.

Additionally, excess capacity exists, especially at certain times of the year due to sap content, to evaporate process water from other on-site as well as off-site sources.

Figure 6:
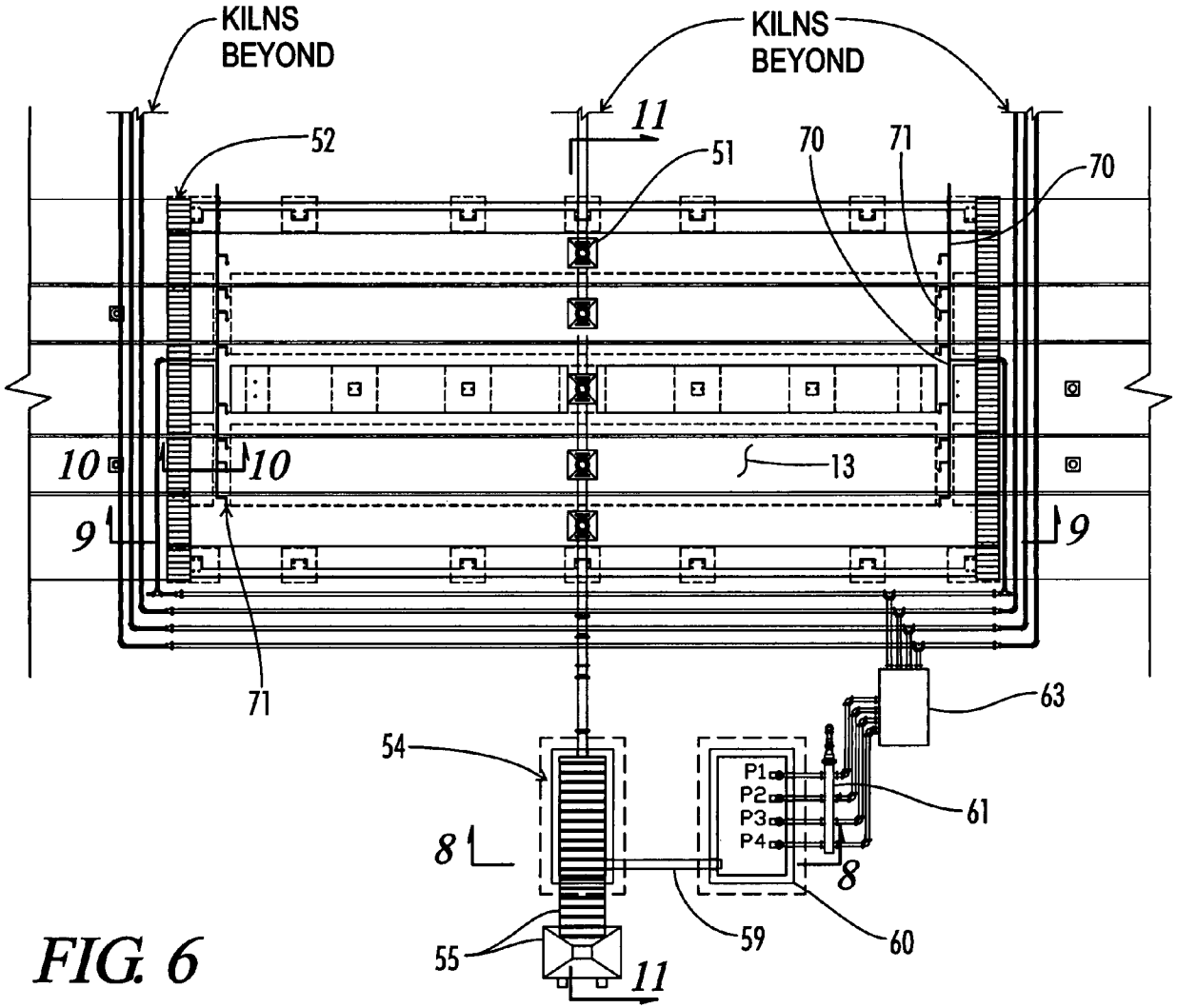
FIG. 6 shows a dry kiln floor and piping layout that is an example of the present invention.

FIGS. 6 through 12 depict a detailed example of the present invention and should not be construed as being limiting thereof. FIG. 6 discloses a dry kiln floor and piping layout plan of an example of the present invention. In this figure, a floor 13 of a chamber interior space is shown that uses a series of drains as the moisture collection device, or moisture collector. These drains include grated sediment trap drains 51 and grated trench drains 52. The drains generally flow to a sedimentation chamber 54. This chamber comprises a conveyor and hopper 55 for mechanized removal or sediment. Downstream from the sedimentation chamber is a pump chamber 60 in the present invention. The pump chamber comprises an inlet 59 to the pump chamber, a discharge header 61, a flush line 62, and a multiple valve layout control cabinet 63. This pump chamber directs fluid to an evaporation unit 70. In this case, the process water is directed back into the kiln chamber for evaporation. This evaporation unit thus comprises flow devices 71 which inject the processed water into the chamber.

Figure 7:
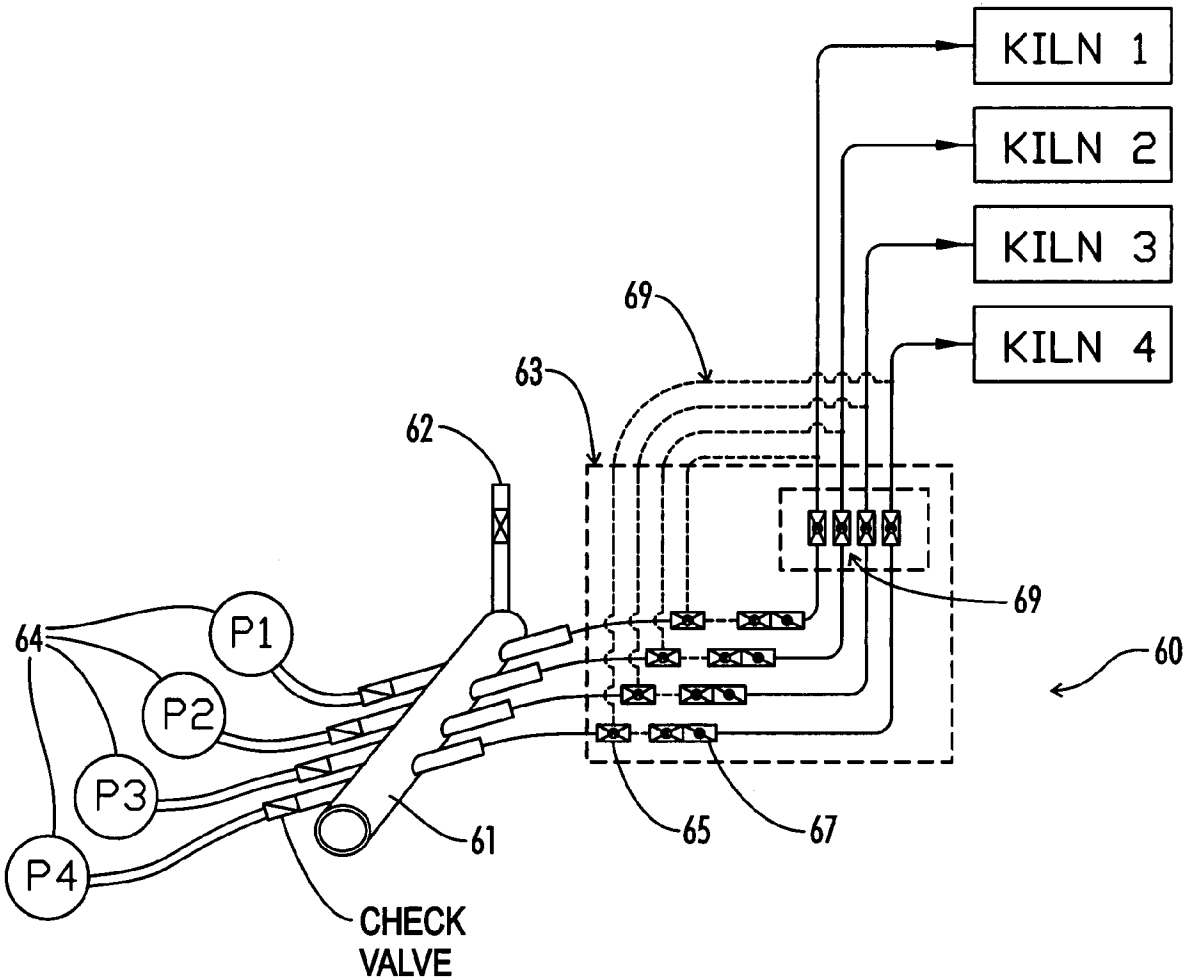
FIG. 7 shows an example of a flow control schematic of a kiln condensate evaporator or evaporation unit that can be used in conjunction with an example of a kiln of the present invention depicted in FIG. 6.

FIG. 7 shows an embodiment of the pump chamber of FIG. 6. The pump chamber depicted in FIG. 7 comprises a common discharge header 61, that is attached to a valved connection for discharge or flushing 62. This embodiment comprises four pumps 64. The pumps direct processed water through an insulated and heated valve cabinet 63. The valve cabinet encloses three-way valves 65, as well as electrically operated valves, manual three-way valves, and check valve combinations 67. This embodiment additionally shows a manual valve bank 68 which assists in directing the processed water back to various kilns for evaporation. This embodiment further comprises a manual bypass system 69. With this pump chamber unit, capability exists to route all flows to any or all of the available kilns. Additionally, liquid receiving tanks may be added as processed water destinations. The valve and control cabinet temperature may be thermostatically controlled.

Figure 8:
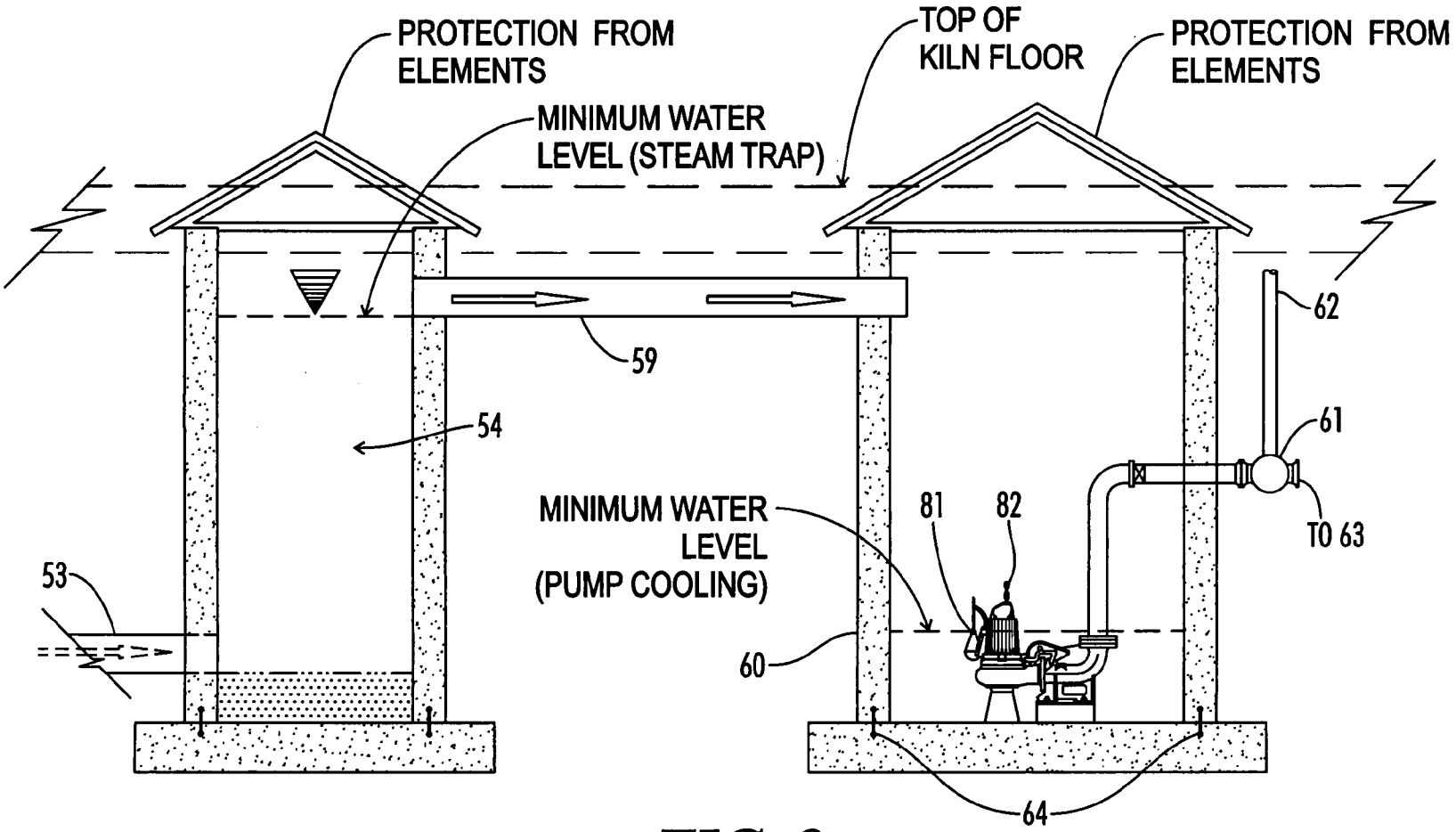
FIG. 8 is a cross section along the line 8—8 in FIG. 6, and depicts examples of sedimentation and pump chambers that may be used with a kiln of the present invention, particularly the example depicted in FIG. 6.

FIG. 8 shows an example of a sedimentation chamber and pump chamber depicted in FIG. 6. An inlet pipe 53 provides a means for water to flow into the sedimentation chamber 54. The water exits the sedimentation chamber via an outlet 59 to the pump chamber 60. The pump chamber, as additionally shown in FIG. 6, comprises a discharge header 61, flush line 62, and an outlet to allow fluid to flow to the flow control cabinet 63. An example of the pump 64 that may be used with the present invention includes one that has a flow control 81 and lifting chain 82.

Figure 9:
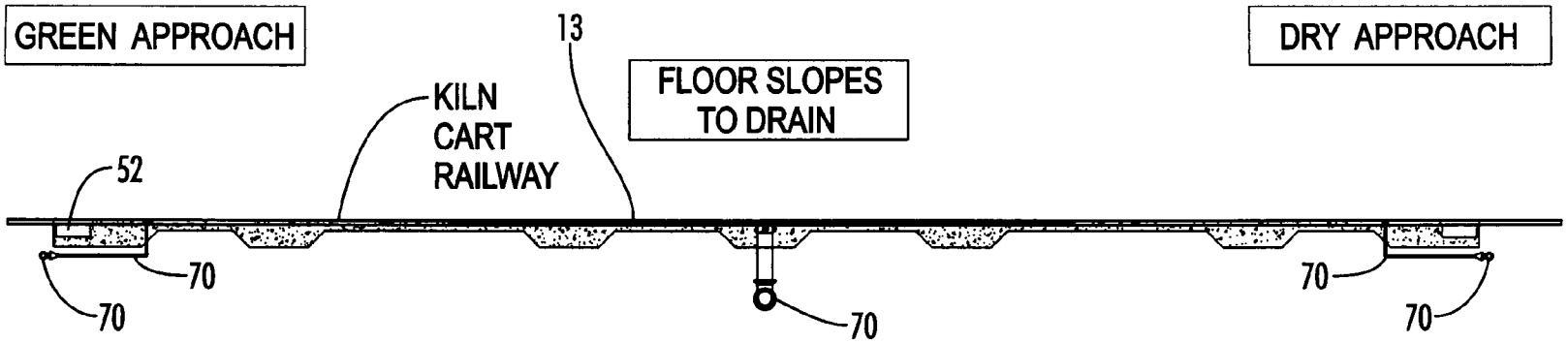
FIG. 9 is a cross section along the line 9—9 in FIG. 6, and depicts examples of drain, concrete floor and footings that may be used with a kiln of the present invention, particularly the example depicted in FIG. 6.

FIG. 9 shows an example of a drain, concrete floor, and footings of this example. In this embodiment, the evaporation unit 70 comprises infeed headers, and discharge pipes. A dry kiln system for drying a stack of lumber, comprising:

at least one kiln chamber defining a chamber interior space capable of receiving a stack of lumber for drying;

a chamber heating source capable of providing heated air;

an air moving device capable of circulating heated air supplied to the chamber interior space;

a condensation collection device for collecting liquid in the chamber interior space; and an evaporation system for evaporating collected liquid from the chamber interior space.

Figure 10:
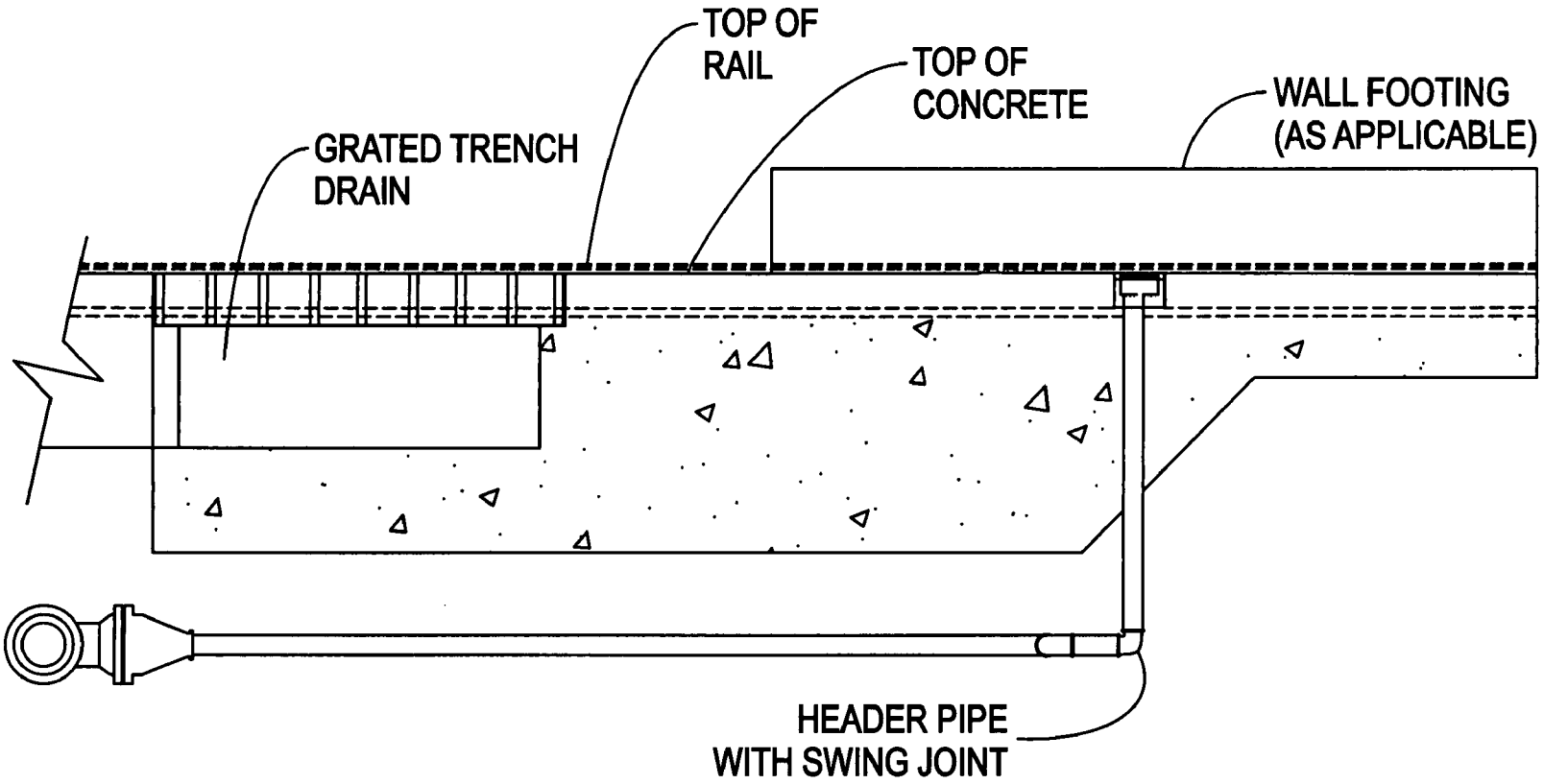
FIG. 10 is a cross section along the line 10—10 in FIG. 6, and depicts an example of a system return device that may be used with a kiln of the present invention, particularly the example depicted in FIG. 6.

FIG. 10 shows an example of a system return device on this embodiment.

Figure 11:
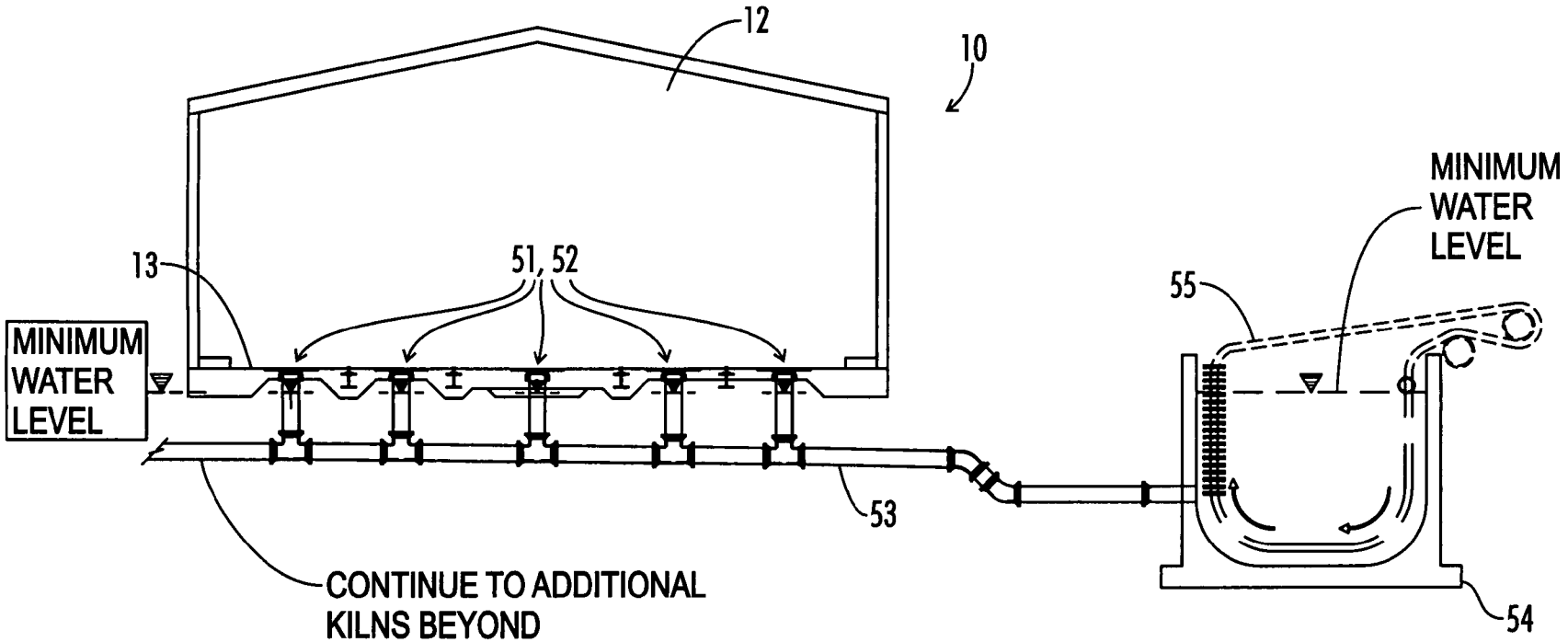
FIG. 11 is a cross section along the line 11—11 in FIG. 6, and depicts an example of a floor and drain layout that may be used with a kiln of the present invention, particularly the example depicted in FIG. 6.

FIG. 11 shows an example of a floor and drain layout of the present invention.

The kiln 10 is shown that comprises the interior chamber 12. The drain system is below the floor 13 of the chamber.

All patents and other publications cited herein are expressly incorporated by reference in their entirety, and are considered as being part of this disclosure.

The invention thus being described in the Specification and Drawing Sheets, it will be apparent to those skilled in the art that various modifications and variations can be made in the present invention without departing from the scope or spirit of the invention.

We claim:

1. A dry kiln system for drying a stack of lumber, comprising:

at least one kiln chamber defining a chamber interior space capable of receiving a stack of lumber for drying;

a chamber heating source capable of providing heated air;

an air moving device capable of circulating heated air supplied to the chamber interior space;

a condensation collection device for collecting liquid in the chamber interior space; and a piping and pump combination to introduce or re-introduce collected liquid to a chamber interior space for conversion into steam inside the chamber interior space.

2. The dry kiln system of claim 1, wherein:

the condensation collection device is an evaporator coil in the chamber interior space.

3. The kiln system of claim 1, further comprising:

a drain system to receive liquid from the condensation device.

4. The dry kiln system of claim 3, wherein the condensation collection device directs liquid to a liquid drainage system.

5. The dry kiln system of claim 1, wherein:

the condensation device comprises a liquid contact surface.

6. The dry kiln system of claim 4, wherein:

the liquid drainage system directs liquid toward a liquid holding tank.

7. The dry kiln system of claim 5, wherein the liquid contact surface slopes to a liquid drain system, utilizing gravity to direct liquid toward a liquid drainage system.

8. The dry kiln system of claim 5, wherein the liquid contact surface is a sloping floor of the chamber interior space.

9. The dry kiln system of claim 1, wherein:

the kiln system further comprises a liquid holding tank and a heating source, wherein the heating source effects evaporation of the liquid in the holding tank.

10. The dry kiln system of claim 1, wherein:

the kiln comprises a liquid holding tank, and heat from the chamber heating source is directed to the liquid holding talk to effect evaporation of the liquid in the holding tank.

11. The dry kiln system of claim 1, wherein the kiln system comprises a pump to direct collected liquid into the kiln chamber for heating to effect evaporation.

12. The dry kiln system of claim 11, wherein the pump directs liquid to a floor surface of the chamber interior space for heating to effect evaporation.

13. The dry kiln system of claim 1, further comprising a plurality of kiln chambers defining a chamber interior space capable of receiving a stack of lumber for drying.

14. The dry kiln system of claim 13, wherein the system further comprises a liquid drain system capable of receiving liquid from each kiln chamber and capable of delivering said liquid to multiple chamber interior spaces.

15. The dry kiln system of claim 13, wherein collected liquid from said plurality of kiln chambers is directed to a common pump chamber for delivery to a chamber interior space.

16. The dry kiln system of claim 15, wherein the kiln system with a plurality of kiln chambers comprises a liquid holding tank with a heat source to effect evaporation.

17. A process for drying lumber, comprising:

providing a kiln system that comprises a chamber interior space for receiving a quantity of stacked lumber;

a chamber heating source for heating the air within the structure for drying the lumber; and a condensation collection device for collecting liquid in the chamber interior space;

placing a quantity of stacked wet lumber within the chamber interior surface;

circulating heated air within the chamber interior surface and about the stacked lumber to dry the lumber and cause liquid in the wet lumber to escape as vapor;

collecting liquid from condensed vapor in the chamber interior surface;

introducing or re-introducing the collected liquid into the chamber interior space; and evaporating said liquid in the chamber interior space.

18. The process of claim 17, wherein collecting and evaporating steps are effected by:

providing a pump chamber and an evaporation unit;

pumping the collected liquid to the evaporating unit to effect evaporation.

19. The process of claim 18, wherein the pump chamber directs liquid collected from more than one chamber interior space.

20. The process of claim 19, wherein the pump chamber directs collected liquid to more than one evaporation unit.

21. The process of claim 17, wherein the evaporation unit is a liquid storage tank downstream from the pump chamber.

22. The process of claim 17, wherein the evaporation unit is a surface of a chamber interior space.

23. A dry kiln system for drying a stack of lumber, comprising:

a plurality of kiln chambers defining a chamber interior spaces capable of receiving a stack of lumber for drying;

a chamber heating source capable of providing heated air;

an air moving device capable of circulating heated air supplied to a chamber interior space;

a condensation collection device for collecting liquid in the chamber interior spaces; and a piping and pump combination that introduces or re-introduces collected liquid to a chamber interior space for conversion into steam inside the chamber interior space;

a liquid drain system capable of receiving liquid from each kiln chamber and capable of delivering said liquid to a chamber interior space.

24. The dry kiln system of claim 23, wherein the dry kiln system comprises a liquid drain system that directs the liquid to a kiln chamber and a holding tank and the piping and pump combination directs liquid from the holding tank to a chamber interior space.

* * * * *